US009842463B2

(12) United States Patent
Simongini et al.

(10) Patent No.: US 9,842,463 B2
(45) Date of Patent: Dec. 12, 2017

(54) UNIFIED WAGERING DATA MODEL

(75) Inventors: Alberto Simongini, Toorak (AU); Chia Min Lee, Kew East (AU)

(73) Assignee: Accenture Global Services Limited, Dublin (IE)

( * ) Notice: Subject to any disclaimer, the term of this patent is extended or adjusted under 35 U.S.C. 154(b) by 472 days.

(21) Appl. No.: 14/373,865

(22) PCT Filed: Jan. 23, 2012

(86) PCT No.: PCT/AU2012/000052
§ 371 (c)(1),
(2), (4) Date: Oct. 15, 2014

(87) PCT Pub. No.: WO2013/110114
PCT Pub. Date: Aug. 1, 2013

(65) Prior Publication Data
US 2015/0072770 A1 Mar. 12, 2015

(51) Int. Cl.
*G07F 17/32* (2006.01)
*G06Q 50/34* (2012.01)

(52) U.S. Cl.
CPC ..... *G07F 17/3225* (2013.01); *G06Q 50/34* (2013.01); *G07F 17/3244* (2013.01); *G07F 17/3288* (2013.01)

(58) Field of Classification Search
CPC ..... G07F 17/3225; G07F 17/3244; G07F 17/3288; G06Q 50/34
See application file for complete search history.

(56) References Cited

U.S. PATENT DOCUMENTS 5,575,474 A * 11/1996 Rossides ..... G07F 17/3288 463/26
5,672,106 A * 9/1997 Orford ..... G06Q 50/34 463/28

(Continued)

FOREIGN PATENT DOCUMENTS

WO WO 2010/019541 A1 2/2010
WO WO 2013/110114 A1 8/2013

OTHER PUBLICATIONS

International Search Report and Written Opinion issued in PCT/AU2012/000052 dated Apr. 13, 2012.

(Continued)

*Primary Examiner* — Corbett B Coburn
(74) *Attorney, Agent, or Firm* — Brinks Gilson & Lione

(57) ABSTRACT

A disadvantage of existing betting operations is the implementation of fixed odds and pari-mutuel betting on specific and dedicated systems. This results in higher acquisition and maintenance costs as compared with a single system. According to the present invention, a single system allows both fixed odds and pari-mutuel betting to be offered on a single system wherein the system effects a computer-implemented method of wagering, including: receiving, via a communications network, a wager from a customer in respect of a wagered event and a wagered product; storing the wager, in an electronic data store, and associating the wager with the wagered event, the wagered product and a customer account, wherein the computer system manages the electronic data store, having stored therein, a plurality of events, a plurality of products and a plurality of customers, all of which are independently defined.

12 Claims, 9 Drawing Sheets

(56) References Cited

U.S. PATENT DOCUMENTS

| | | | | |
|---|---|---|---|---|
| 5,830,068 | A * | 11/1998 | Brenner | G06Q 50/34 463/42 |
| 7,201,658 | B2 * | 4/2007 | Marshall | G06Q 50/34 379/93.13 |
| 2002/0065566 | A1 * | 5/2002 | Aronson | G07F 17/32 700/91 |
| 2004/0058731 | A1 * | 3/2004 | Rossides | G06Q 50/34 463/42 |
| 2004/0111358 | A1 | 6/2004 | Lange et al. | |
| 2004/0229671 | A1 * | 11/2004 | Stronach | G06Q 50/34 463/6 |
| 2004/0242322 | A1 * | 12/2004 | Montagna | A63F 13/10 463/29 |
| 2005/0181862 | A1 | 8/2005 | Asher et al. | |
| 2006/0258438 | A1 * | 11/2006 | Platis | G07F 17/32 463/25 |
| 2007/0155483 | A1 * | 7/2007 | Walker | G07F 17/32 463/25 |
| 2008/0207310 | A1 | 8/2008 | Mindes | |
| 2012/0220364 | A1 * | 8/2012 | Koerner | G06Q 30/0209 463/25 |

OTHER PUBLICATIONS

Patent Examination Report No. 1 issued in Australian Patent Application No. 2012327165 dated Oct. 18, 2013.
Patent Examination Report No. 2 issued in Australian Patent Application No. 2012327165 dated May 23, 2014.
Extended European Search Report for corresponding European application No. 12866971.0, dated Aug. 20, 2015.

* cited by examiner

UNIFIED WAGERING DATA MODEL

FIELD OF THE INVENTION

The present invention relates to a system, method and computer instruction code for wagering. Although not exclusively, the invention is particularly useful for implementing a "unified" wagering system.

BACKGROUND TO THE INVENTION

The terms "gambling" and "betting" refer to a risking of something, typically money, with respect to the outcome of a future event. Typically, two or more people gamble on different outcomes of the event, and the winner, or winners, collect all, or a substantial portion of a prize pool. The event may be a sporting, racing, or political event, for example. The ratio between the risked amount and a return is typically referred to as "odds". Typically, the odds of an outcome correlate with the likelihood of an outcome occurring.

A horse for example, may have odds of 50 to 1 to win a particular race. If $1 is wagered on this outcome, the return is $50 in the event the horse wins the race. The likelihood of the horse winning is considered to be approximately 1/50.

Betting is typically coordinated between gamblers by a third party entity. In horse racing, for example, this coordination has been traditionally satisfied by bookmakers at a race track. More recently, bookmakers have been replaced by larger companies offering gambling external to where an event occurs, sometimes via the Internet.

There are a number of betting products on the market, some specific to a type of event, others more generic. For example, a trifecta is a betting product where an outcome is the horses, for example, that finish in first, second and third places. Another, more generic betting product, is simply betting on a win for a horse, team, or political party, for example.

Another category of betting products relates to the calculation of odds. These forms include "pari-mutuel" betting and "fixed odds" betting.

Pari-mutuel betting is a form of betting in which the odds are not known to a gambler when placing a bet. The odds are determined after new bets are no longer allowed. The odds change as bets are placed on an event. In other words, the odds are dependent upon the other bets in the pool as the total pool is split among the winners. In pari-mutuel betting, the bookmaker has no risk as the betters are effectively betting against each other with the winners sharing the combined pool.

Fixed-odd betting is a form of betting where the odds are known to a better when placing a bet. The bookmaker chooses the odds for the event. These odds may be continually updated, but a gambler is provided the odds offered at the time the bet is placed, irrespective of any later changes. The bookmaker may base the odds upon previous bets, his own knowledge and/or other factors.

Modern gambling has generally moved from the traditional bookmakers to larger companies running complex information technology systems. Services are often provided directly over the Internet, or via communications means to a number of smaller outlets. As these systems are typically large, the odds provided/offered are typically accurate.

A disadvantage of the above described prior art systems is that separate systems are required for different betting products. For example, fixed-odd and pari-mutuel betting, if both offered by a betting provider, are provided by specific and dedicated systems. This results in higher acquisition and maintenance costs as compared with a single system as multiple systems must be purchased, developed and maintained. The ongoing additional cost of maintaining numerous systems is considerable and represents a significant cost to a business offering both fixed odds and pari-mutuel betting products.

A further disadvantage of known systems is that they are not easily extensible to allow for the addition of new products. Products and the events to which a product refers, are inseparable in known systems. Thus the addition of a new product requires substantial system modification which usually incurs a significant cost in the form of high skilled labour costs to attend to any requisite modifications.

Therefore, there is a need to overcome or alleviate one or more of the above identified problems associated with known wagering systems.

SUMMARY OF THE INVENTION

According to one aspect, the present invention provides a computer-implemented method of wagering, wherein a computer system manages an electronic data store, having stored therein, a plurality of events, a plurality of products and a plurality of customer accounts, all of which are independently defined, the method including: receiving, via a communications network, a wager from a customer in respect of an event of the plurality of events, a product of the plurality of products and a customer account of the plurality of customer accounts; and storing the wager, in the electronic data store, and associating the wager with the event, the product and the customer account.

By independently defining various entities such as events, products and customer accounts, the system and method of the present invention can record and manage any type of wager including pari-mutuel and fixed odds. Effectively, the method and system of the present invention is configured to treat the wager as the primary entity with relationships between the wager and other entities, such as specific products and the customer account, being formed according to the particular circumstances of the wager. Adopting this approach allows a unified wagering system to be established that accommodates a range of different types of betting including pari-mutuel and fixed odds wagering.

According to an embodiment, the computer-implemented method of wagering further includes receiving, via a communications network, information relating to an outcome of the event; determining, on a computer processor, an outcome of the wager; and transmitting, via a communications network, the outcome of the wager.

According to another embodiment, the computer-implemented method of wagering further includes receiving, via a communications network, a request for event information from the customer; selecting, on a computer processor, and retrieving, from the data store, one or more events; and transmitting, via a communications network, an event list including information relating to the one or more events, to the customer; wherein the event is an event of the one or more events in the event list.

The request and the wager may be received from the customer via a channel, the channel including one of a purpose built kiosk, a computer application, and a browser based application.

The one or more events may be selected according to at least one of customer or account preference, jurisdiction and location. Additionally, or alternatively, the event list is sorted according to at least one of customer or account preference, jurisdiction and location.

According to another embodiment, the computer-implemented method of wagering further includes: retrieving, from the data store, a plurality products; and associating each of the one or more events with one or more products of the plurality of products.

The one or more products associated with each event may be included in the event list. Alternatively, links to the one or more products associated with each event may be included in the event list.

The plurality of products may include fixed odds and pari-mutuel products.

According to another aspect, the present invention provides a computer system including: a database for maintaining data associated with at least one event, a plurality of products, and at least one customer account, wherein the at least one event and the at least one customer account are stored independently to the plurality of products; and a computer coupled to the database, wherein the computer includes a processor and a memory, the processor and memory configured to: generate, based upon input from a customer associated with a customer account of the at least one customer account, records pertaining to a betting instance including the at least one event, a product from the plurality of products, and the customer account; wherein the plurality of products includes pari-mutuel and fixed odds products.

According to an embodiment, the processor and memory are additionally configured to: retrieve information relating to the at least one event from the database; and associate the at least one event with one or more of the plurality of products.

According to yet another aspect, the present invention provides a computer implemented wagering system, the wagering system including: an event module for storing a plurality of events; a product catalogue module for storing a plurality of products, the plurality of products including at least pari-mutuel and fixed odds products; a customer data module for storing customer account data for a plurality of customers; and a betting instance module, for generating betting instances, the betting instances including an association to an event from the event module, to a product from the product catalogue module, and to a customer account from the customer data module.

The event module may include, for each of the plurality of events at least one contestant, and the betting instance module an association to a contestant from the event module.

The customer data module may include, for a customer, a plurality of accounts, and the betting instance module includes an association between the customer and an account of the plurality of accounts.

According to an embodiment, the computer implemented wagering system further includes an event-product rule module, which includes rules relating to which products from the plurality of products may be associated with an event.

According to another embodiment, the computer implemented wagering system further includes an account-event rule module, which includes rules relating to which events from the plurality of events may be associated with a customer account.

The computer implemented wagering system may include a channel module, for storing information relating to a plurality of channels. The system may include a customer account-channel rule module, which includes rules relating to which channels from the plurality of channels a customer account has access.

The computer implemented wagering system may include a product-channel rule module, which includes rules relating to which channels from the plurality of channels a product is available.

The computer implemented wagering system may include an event channel rule module, which includes rules relating to which channels from the plurality of channels an event is available.

According to another aspect, the invention provides a computer program embodied on a computer readable medium including software code adapted, when executed on a data processing apparatus, to provide a method of wagering as described above.

BRIEF DESCRIPTION OF THE DRAWINGS

To assist in understanding the invention and to enable a person skilled in the art to put the invention into practical effect, embodiments of the invention are described below by way of example only with reference to the accompanying drawings, in which.

Figure 1:
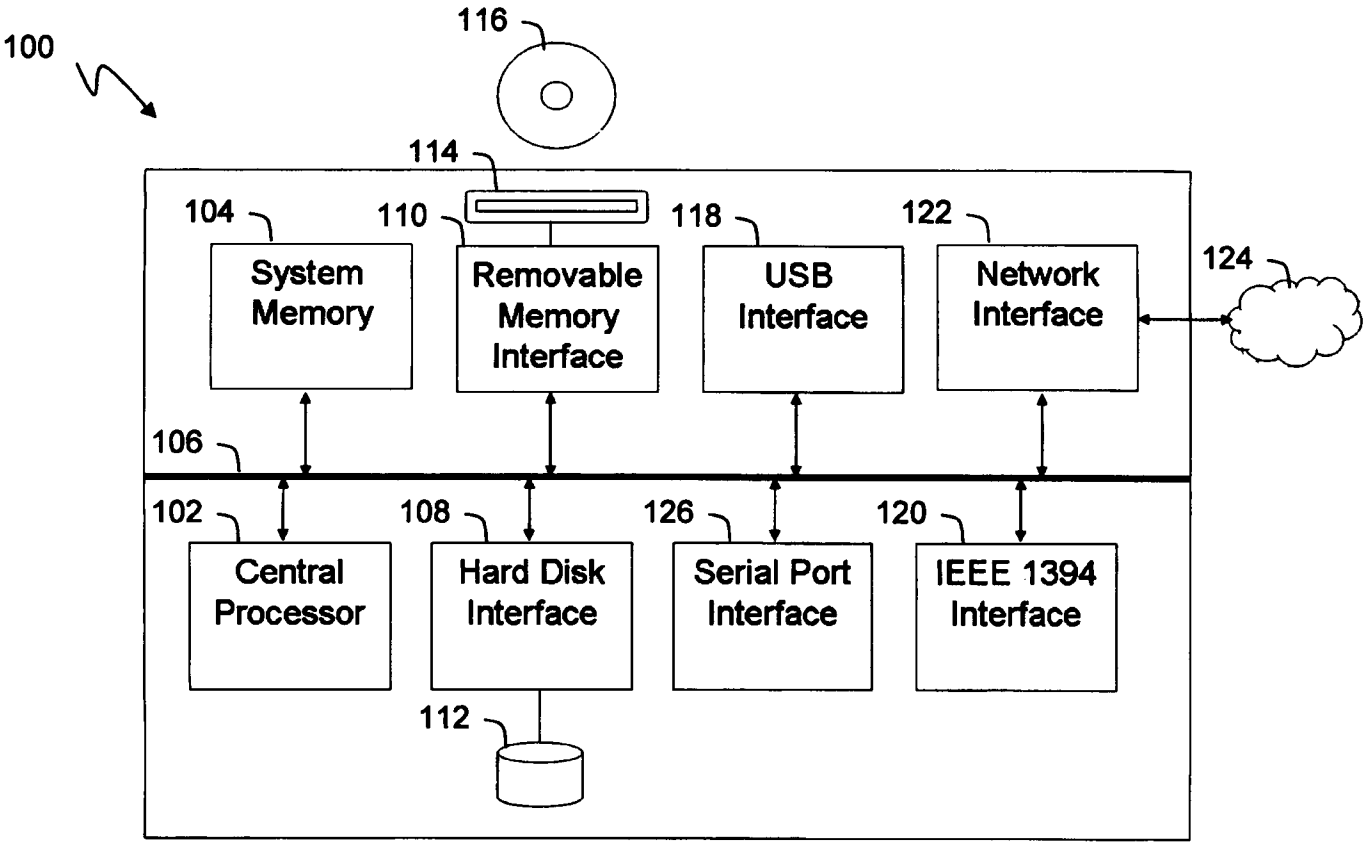
FIG. 1 is a diagrammatic illustration of a computer system, with which the present invention may be implemented.

Skilled readers will appreciate that minor deviations from the layout of components as illustrated in the drawings will not detract from the proper functioning of the disclosed embodiments of the present invention.

DETAILED DESCRIPTION OF EMBODIMENTS

Embodiments of the present invention include a wagering system, method and computer software. Elements of the invention are illustrated in concise outline form in the drawings, showing only those specific details that are necessary for understanding the embodiments of the present invention, but so as not to clutter the disclosure with excessive detail that will be obvious to a skilled reader.

FIG. 1 is a diagrammatic illustration of a computer system 100, with which the present invention may be implemented.

The computer system 100 includes a central processor 102, a system memory 104 and a system bus 106 that couples various system components including the system memory 104 to the central processor 102. The system bus 106 may be any of several types of bus structure including a memory bus or memory controller, a peripheral bus, and a local bus using any of a variety of bus architectures. The structure of system memory 104 is well known to those skilled in the relevant field of technology and may include a basic input/output system (BIOS) stored in a read only memory (ROM) and one or more program modules such as operating systems, application programs and program data stored in random access memory (RAM).

The computer system 100 may also include a variety of interface units and drives for reading and writing data. In particular, the computer system 100 includes a hard disk interface 108 and a removable memory interface 110 respectively coupling a hard disk drive 112 and a removable memory drive 114 to system bus 106. Examples of removable memory drives 114 include magnetic disk drives and optical disk drives. The drives and their associated computer-readable media, such as a Digital Versatile Disc (DVD) 116 provide non-volatile storage of computer readable instructions, data structures, program modules and other data for the computer system 100. A single hard disk drive 112 and a single removable memory drive 114 are shown for illustration purposes only and with the understanding that the computer system 100 may include several of such drives. Furthermore, the computer system 100 may include drives for interfacing with other types of computer readable media.

The computer system 100 may include additional interfaces for connecting devices to system bus 106. FIG. 1 shows a universal serial bus (USB) interface 118 which may be used to couple a device to the system bus 106. An IEEE 1394 interface 120 may be used to couple additional devices to the computer system 100.

The computer system 100 can operate in a networked environment using logical connections to one or more remote computers or other devices, such as a server, a router, a network personal computer, a peer device or other common network node, a wireless telephone or wireless personal digital assistant. The computer 100 includes a network interface 122 that couples system bus 106 to a local area network (LAN) 124. Networking environments are commonplace in offices, enterprise-wide computer networks and home computer systems.

A wide area network (WAN), such as the Internet, can also be accessed by the computer system 100, for example via a modem unit connected to serial port interface 126 or via the LAN 124.

It will be appreciated that the network connections shown and described are exemplary and other ways of establishing a communications link between the computers can be used. The existence of any of various well-known protocols, such as Frame Relay, Ethernet, TCP/IP, FTP, HTTP and the like, is presumed, and the computer system 100 can be operated in a client-server configuration to permit a user to retrieve web pages from a web-based server. Furthermore, any of various conventional web browsers can be used to display and manipulate data on web pages.

The operation of the computer system 100 can be controlled by a variety of different program modules. Examples of program modules are routines, programs, objects, components, and data structures that perform particular tasks or implement particular abstract data types. The present invention may also be practiced with other computer system configurations, including hand-held devices, multiprocessor systems, microprocessor-based or programmable consumer electronics, mainframe computers, personal digital assistants and the like. Furthermore, the invention may also be practiced in distributed computing environments where tasks are performed by remote processing devices that are linked through a communications network. In a distributed computing environment, program modules may be located in both local and remote memory storage devices.

Figure 2:
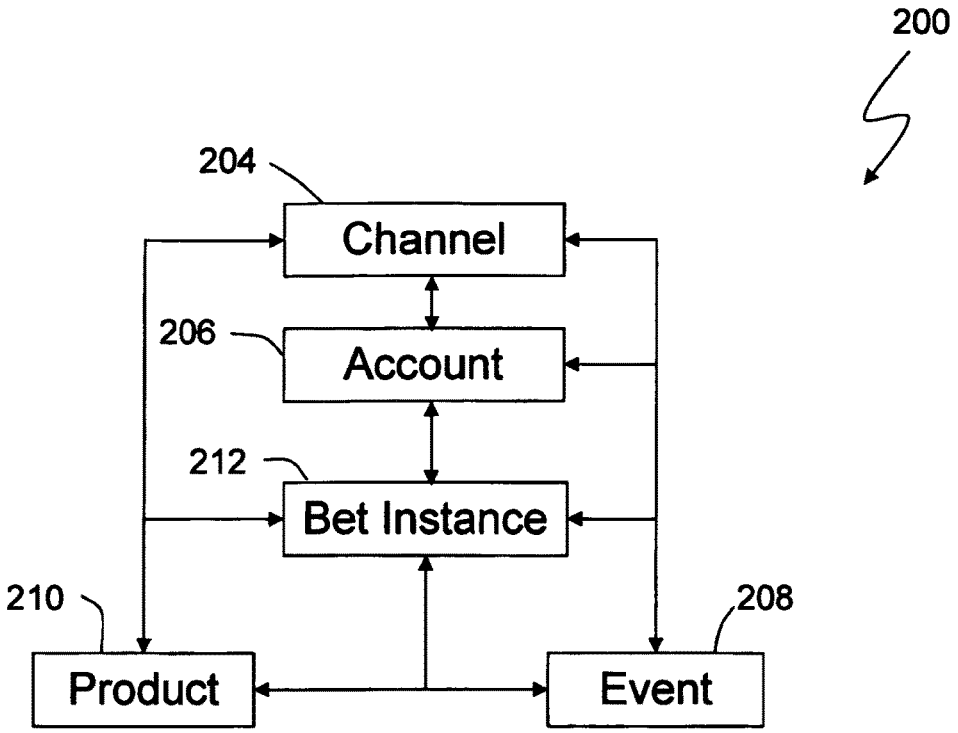
FIG. 2 is a diagrammatic illustration of a unified wagering system according to an embodiment of the present invention.

FIG. 2 is a diagrammatic illustration of a unified wagering system 200 according to an embodiment of the present invention.

A customer interacts with the system 200 through a channel 204 connected to the system 200. The channel 204 allows the customer to access his or her account 206 and to place a bet on an event 208. Examples of channels 204 include a mobile phone, a kiosk located at a betting location, and a web browser running on a computer.

The account may, for example, include customer preferences, customer jurisdiction, or other details of the customer. The customer may obtain access to his or her account through an authorization module that authorises the credentials of the customer. Examples of credentials include a username, password, smart card or digital certificate. Authorization modules and authentication are well known in the art.

Each customer may be associated with one or more accounts. If a customer is associated with more than one account, the authorization module may also select an account based upon credentials, for example.

After authentication, the customer may view an event 208 to which a bet can be placed. Rather than a single event 208, as shown in FIG. 2, a plurality of events 208 are typically offered for betting. The plurality of events 208 may be filtered based upon preferences of the customer, a location, the channel used, account preferences, account jurisdiction, or by other means. The events 208 are advantageously sorted, for example by event date or alphabetically.

The system 200 includes a plurality of products 210. Examples of products 210 include betting on a win, a place, quinella, trifecta, etc. The plurality of product 210 includes both fixed odds and pari-mutuel (variable odds) products.

Each event 208 is matched with a product 210 or a plurality of products 210 that are allowed for that event. For example, a sports match may allow betting on a win, but not a place. The products 210 available for an event 208 may advantageously change over time. For example, for sporting events, certain products 210 may be made available after the event 208 has begun.

The customer may then select to gamble an amount of money on an outcome of an event 208. A bet instance 212 is generated including a product instance, an event instance, and a customer/account instance.

The products 210, the events 208 and the accounts 206 are stored in a database. The products 210, the events 208 and the accounts 206 are stored separately in the database. In other words, the products 210 are defined independently from the events 208 and accounts 206, and the events 208 are defined independently from the accounts 206.

The database is designed using an object oriented approach, which includes product objects, event objects and customer objects. The product object allows for the inclusion of both fixed odds and Pari-mutuel (variable odds) products.

The independent definitions, especially of the events 208 and products 210, allows for new products to easily be defined. Additionally, multiple products 210 for a single event 208 are easily added to the system without a large amount of redundancy.

Figure 3:
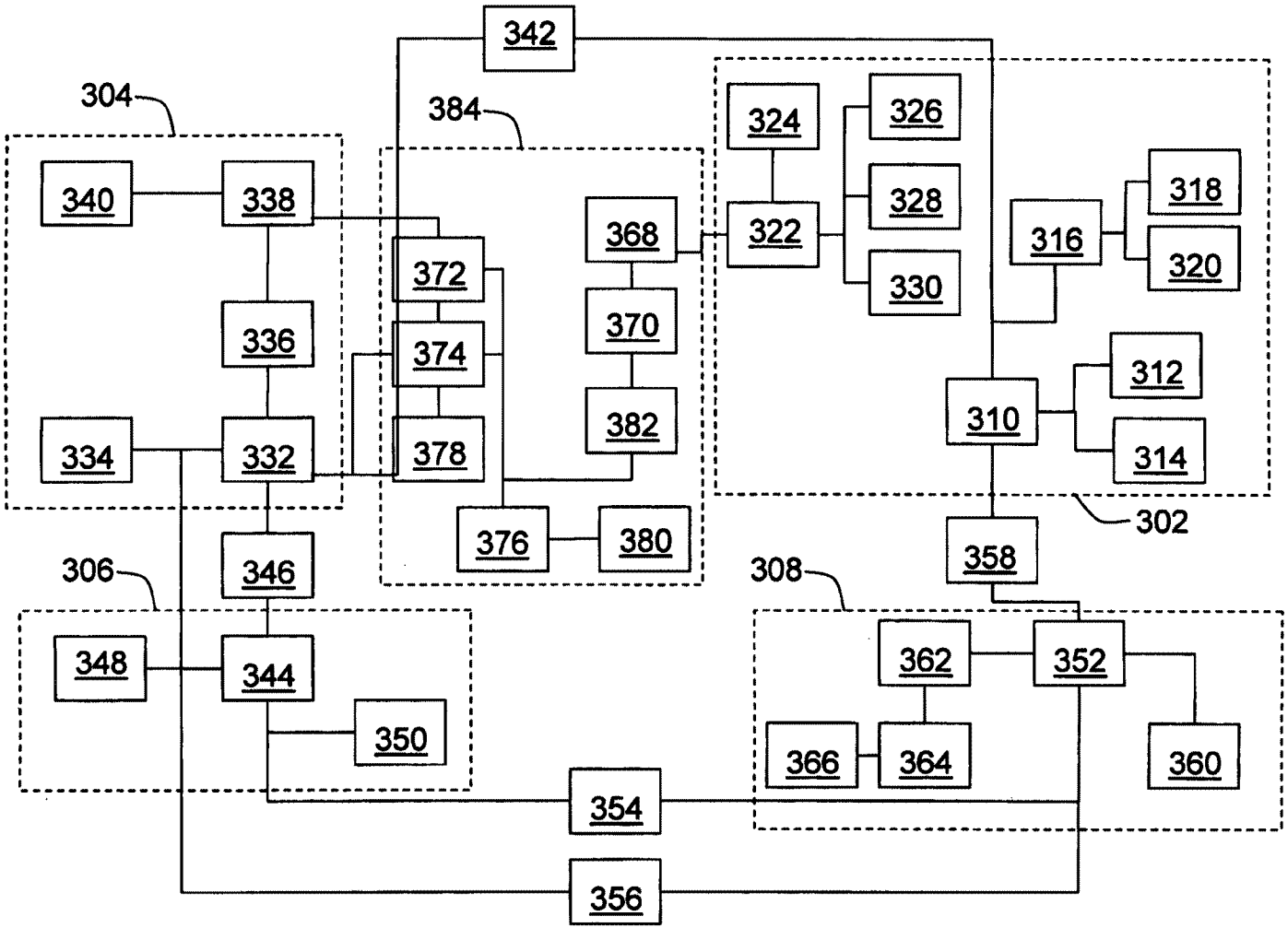
FIG. 3 illustrates a wagering system, according to an embodiment of the invention.

FIG. 3 illustrates a wagering system 300, according to an embodiment of the invention. The system 300 includes an account module 302, an event module 304, a product module 306, and a channel module 308. Each of the modules 302, 304, 306, 308 defines the data structures of the system 300. The system 300 additionally includes a betting instance module 384 which includes instances of the data structures of the modules 302, 304, 306, 308.

The account module 302 specifies fields or parameters of an account. The account module 302 includes an account type 310. The account type 310 is associated with a jurisdiction 312 and a tier 314. Examples of jurisdictions 312 include country (e.g. Australia) and state (e.g. New South Wales, NSW). Examples of tiers 314 include Bronze, Silver and Platinum and indicate a membership status of the account. The account type 310 is associated with one or more account specifications 316 which include a blackbook 318 and one or more preferences 320.

The account module 302 includes a customer type 322. The customer type is associated with one or more customer specifications 324, an affiliate 326, a third party 328 and a physical person 330.

The account module 302 is connected to the event module 304. An event type 332 of the event module 304 is connected to the account type 310 of the account module 302 via an account-event rule configuration 342.

The account-event rule configuration 342 may specify rules which govern whether an account has access to an event. For example, premium events, such as pay per view boxing, may only be available to Platinum members. Additionally, certain events may be illegal to gamble on in certain jurisdictions.

The event type 332 provides information about an event through a categorisation. Examples of event types 332 include race, match, game, round and fight. The event type 332 may be associated with event specifications 334. The event type 332 is associated with a contestant type 338 through one or more event-contestant rule configurations 336. A contestant type 338 may be, for example, a team, a player, or a horse. The contestant type 338 may be associated with contestant specifications 340.

The event module 304 is connected to the product module 306. A product type 344 of the product module 306 is connected to the event type 332 of the event module 304, through an event-product rule configuration 346. The event-product rule configuration 346 may specify products types 344 that are compatible with an event type 332. This may include, for example, that a trifecta product, i.e. first, second and third placing in a race, may only relate to horse or greyhound racing events, and not to other events such as sporting matches.

The product module 306 may include product bundles 348 associated with a product type 344, and product specifications 350. The product specifications 350 includes the type of odds offered for a product, including fixed odds and pari-mutuel (variable) odds.

The event module 304, the product module 306, and the account module 302 are connected to the channel module 308. The channel module provides information regarding access to the wagering system 300, through device descriptions, for example.

A channel type 352 of the channel module is connected to the product type 344 of the product module 306 via a product-channel rule configuration 354. The product-channel rule configuration 354 may specify a channel type 352 that is available for a certain product type 344. For example, a live odds product may only be available via the Internet.

The channel type 352 of the channel module is connected to the event type 332 of the event module 304 via a channel-event rule configuration 356. The channel-event rule configuration 356 may specify a channel type 352 over which an event type 332 is available. For example, a local horse race event type may only have products available via a local outlet.

The channel type 352 of the channel module 308 is connected to the account type 310 of the account module 302 via an account-channel rule configuration 358. The account-channel rule configuration 358 may specify a channel type 352 that is available to an account type 310. For example, gambling via the internet may not be available to certain account types 310 depending on their jurisdiction 312, for example.

The channel module 308 may include channel specifications 360 associated with a channel type 352. Additionally, a device type 364 may be associated with a channel type 352 via a channel-device rule configuration 362. The device type 364 may also have associated device specifications 366.

The betting instance module 384 is central to the system 300, and includes instances of each of the major features described above that are associated with a bet. A customer instance 368 is associated with a customer type 322, an account instance 370 is associated with an account type 310, a product instance 376 is associated with a product type 344, an event instance 374 is associated with an event type 332, and a contestant instance 372 is associated with a contestant type 338.

The customer instance 368 is associated with one or more account instances 370. One or more contestant instances 372 are associated with a product instance 376, and an event instance 374 is associated with a product instance 376. The betting instance module 384 additionally includes an event result 378 associated with the event instance 374. Additionally, a dividend and prices 380 are associated with a product instance 376.

The account instance 370 and the product instance 376, along with their associated data as described above, together make a 'bet ticket' 382.

Figure 4:
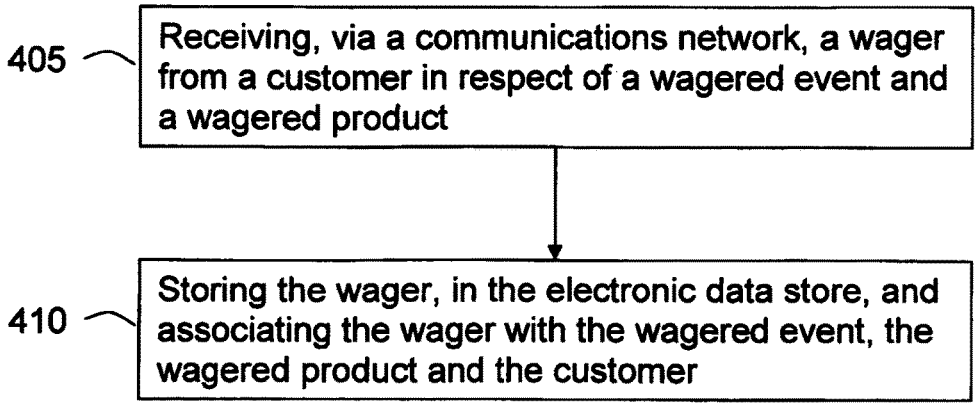
FIG. 4 is a diagrammatic illustration of a method of wagering, from the view of a computer system, according to an embodiment of the present invention.

FIG. 4 is a diagrammatic illustration of a method of wagering 400, from the view of a computer system, according to an embodiment of the present invention.

The computer system manages an electronic data store. The electronic data store has a plurality of events, a plurality of products and a plurality of customer accounts stored thereon, all of which are independently defined.

At step 405, a wager is received, via a communications network and from a customer, in respect of a wagered event and a wagered product.

The communications network may, for example, include the Internet, but as will be readily understood by a skilled reader, any suitable communications network may be used.

The wager may include explicit reference to an event, a product, an outcome, and an account, for example. Alternatively, the wager may include an identifier associated with wager details known by the system. This may include a 'favourite' wager type, a suggested wager, or a response to a list of predetermined wagers, for example.

At step 410, the wager is stored in the electronic data store. The wager is associated with the wagered event, the wagered product and the customer.

The wagered product, the wagered event and the customer are stored in a database as instances of a product definition, an event definition and a customer definition. The products are thus defined independently from the events and the customers, and the events are defined independently from the customers, through their separate definitions.

Figure 5:
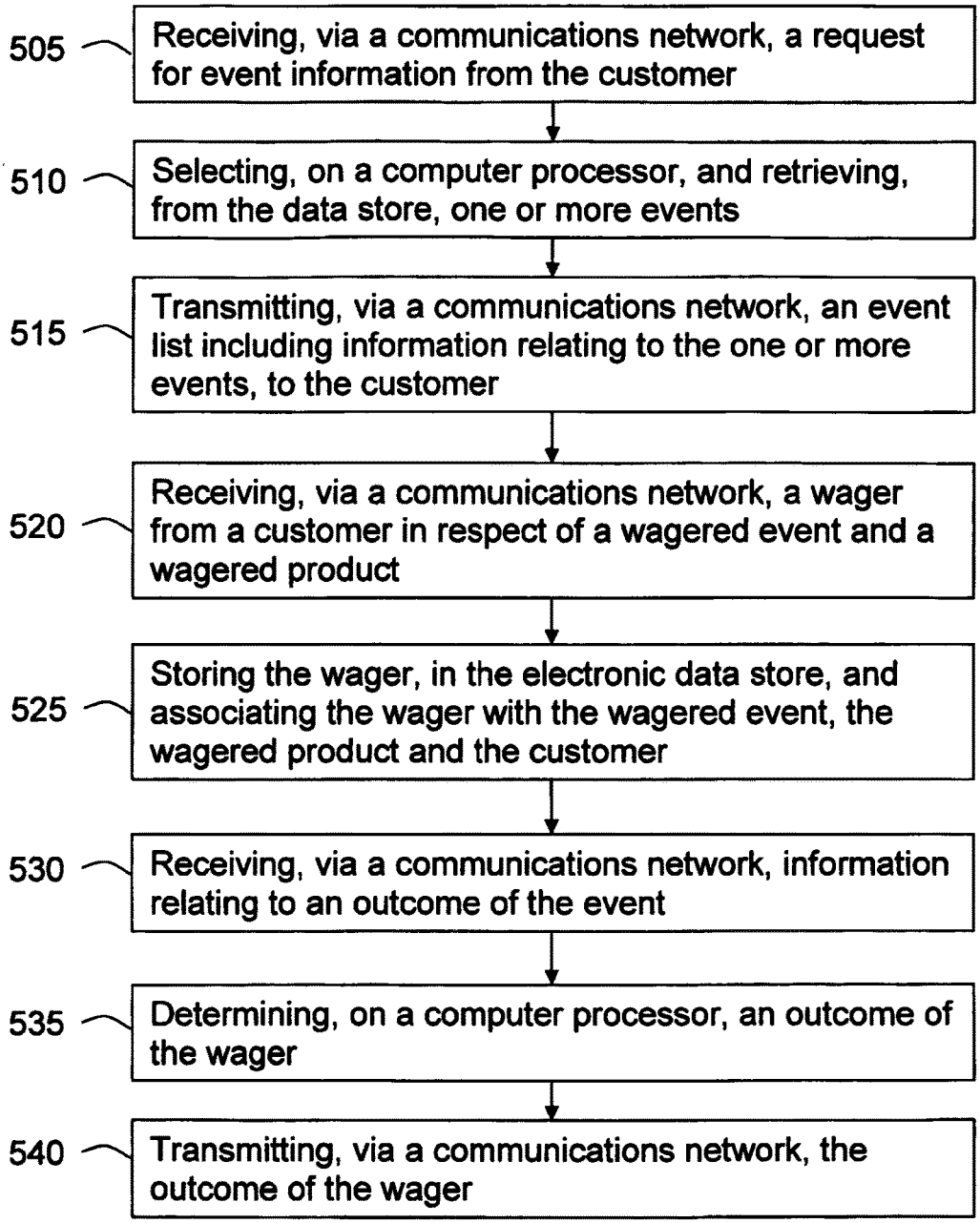
FIG. 5 is a diagrammatic illustration of a method of wagering, from the view of a computer system, according to an embodiment of the present invention.

FIG. 5 is a diagrammatic illustration of a method of wagering 500, from the view of a computer system, according to an embodiment of the present invention.

The method of wagering 500 is similar to the method of wagering 400, and includes a similar electronic data store.

At step 505, a request for event information is received, via a communications network, from a customer. The request may include requesting a web page containing the event information, or any other suitable form of data request.

At step 510, one or more events are selected, on a computer processor, and retrieved from the data store. The one or more events may be selected based upon a location of a customer, a preference of the customer, a jurisdiction of the customer, or based upon any other suitable parameter.

At step 515, an event list, including the one or more events from step 510, is transmitted, via a communications network, to the customer. The event list may include a web page, or raw data to be presented by an application.

The event list may include links to products which are available for each event. The event list may, for example, comprise a list of events with associated products. The products may be directly part of the event list, or accessible via one or more additional lists or pages.

At step 520, a wager is received, via a communications network and from the customer, in respect of a wagered event and a wagered product.

The wager may be received as an identifier embedded in the event list, for example, or through explicit identification.

At step 525, the wager is stored in the electronic data store. The wager is associated with the wagered event, the wagered product and the customer.

The wagered product, the wagered event and the customer are stored in a database as instances of a product definition, an event definition and a customer definition. The products are thus defined independently from the events and the customers, and the events are defined independently from the customers, through their separate definitions.

At step 530, information relating to an outcome of the event is received, via a communications network. The information may include a winning person, horse or team, for example, but may include further details such as a time, placements, a score, or similar information.

At step 535, an outcome of the wager is determined on a computer processor.

The outcome may be determined using the outcome information 520 alone, or in combination with other information. The outcome may, for example, be calculated as a wagered amount multiplied by an odds of the outcome. The odds may be determined at the time the wager was placed, i.e. fixed odds betting, and stored in a data store associated with the wager. Alternatively, the odds may be determined when no further wagering is allowed for the event, e.g. pari-mutuel wagering, and stored in a data store associated with the event.

At step 540, the outcome of the wager is transmitted via the communications network. The outcome may be transmitted to the customer, possibly including information on how to redeem a winnings. The outcome may be transmitted to a gambling agent, or other person, which may handle payouts for the event.

Figure 6:
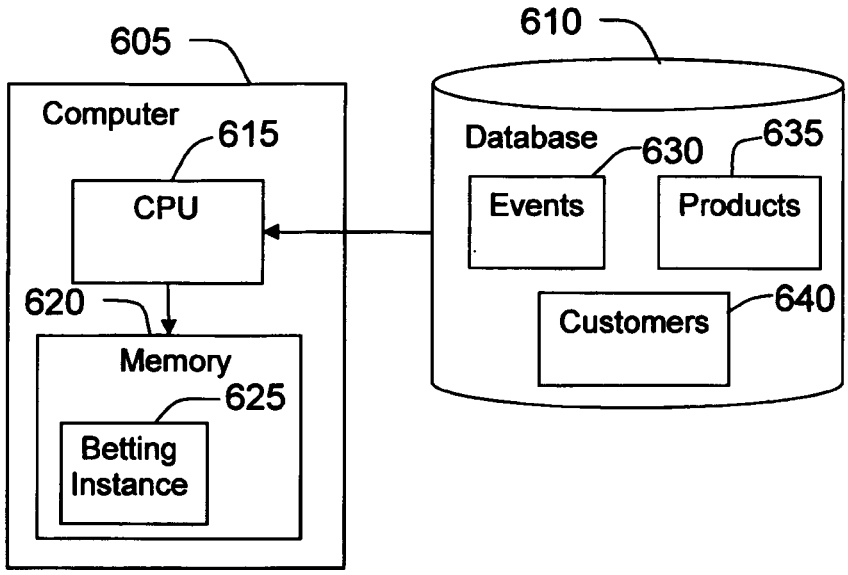
FIG. 6 is a diagrammatic illustration of a wagering system, according to an embodiment of the present invention.

FIG. 6 is a diagrammatic illustration of a wagering system 600, according to an embodiment of the present invention.

The wagering system includes a computer 605 and a database 610. The database 610 may be part of the computer, or alternatively connected to the computer via a computer interface.

The computer 600 includes a central processor 615 connected to a memory 620. The memory includes a betting instance 625.

The database 610 includes an events table 630, a products table 635 and a customers table 640. The database 610 is accessible to the central processor 615 of the computer 605. The database 610 may have an SQL query interface, or any other suitable interface.

By independently defining events table 630, a products table 635 and a customers table 640, the system of the present invention can record and manage any type of wager including pari-mutuel and fixed odds, efficiently.

Figure 7:
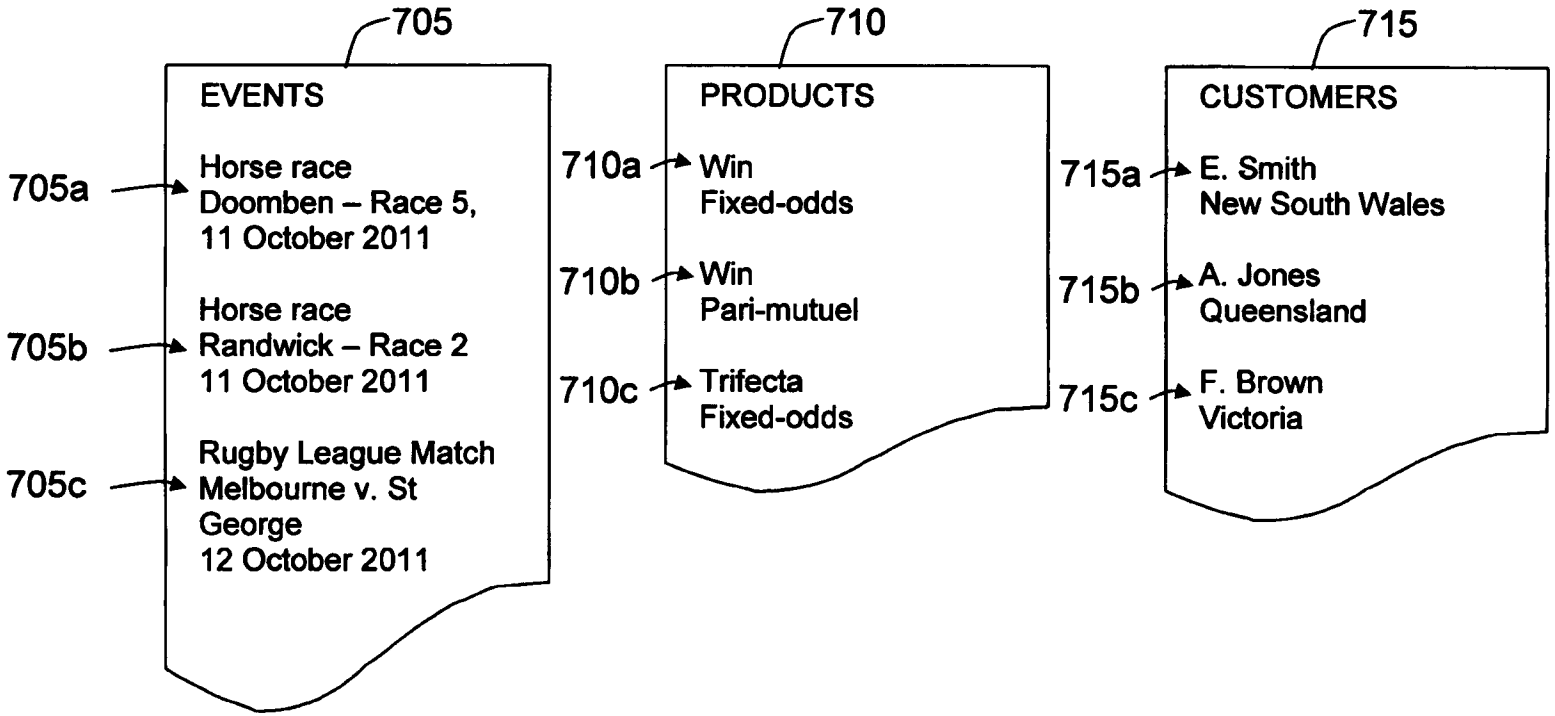
FIG. 7 is a diagrammatic illustration of a database, according to an embodiment of the present invention.

FIG. 7 is a diagrammatic illustration of a database 700, according to an embodiment of the present invention.

The database 700 includes an events table 705, a products table 710 and a customers table 715.

The events entity 705 includes a plurality of entries 705*a-c*, each entry 705*a-c* corresponding to an event. Each entry 705*a-c* may include fields identifying an event type, an event location, and event identifier, and an event date, for example.

The products entity 710 includes a plurality of entries 710*a-c*, each entry 710*a-c* corresponding to an event. Each entry 710*a-c* may include fields identifying an outcome that is being bet on, and a product type.

The accounts entity 715 includes a plurality of entries 715*a-c*, each entry 715*a-c* corresponding to a customer account. Each entry 715*a-c* may include fields identifying a name of the customer, and a jurisdiction.

As will be readily understood by a person skilled in the art, the entries 705*a-c*, 715*a-c*, 720*a-c* may include more or fewer fields that those described above. For example, each entry may be associated with a unique key.

The database 700 may additionally including betting instance information. The betting instance information is advantageously stored as a separate table which references the events table 705, a products table 710 and a customers table 715.

Figure 8:
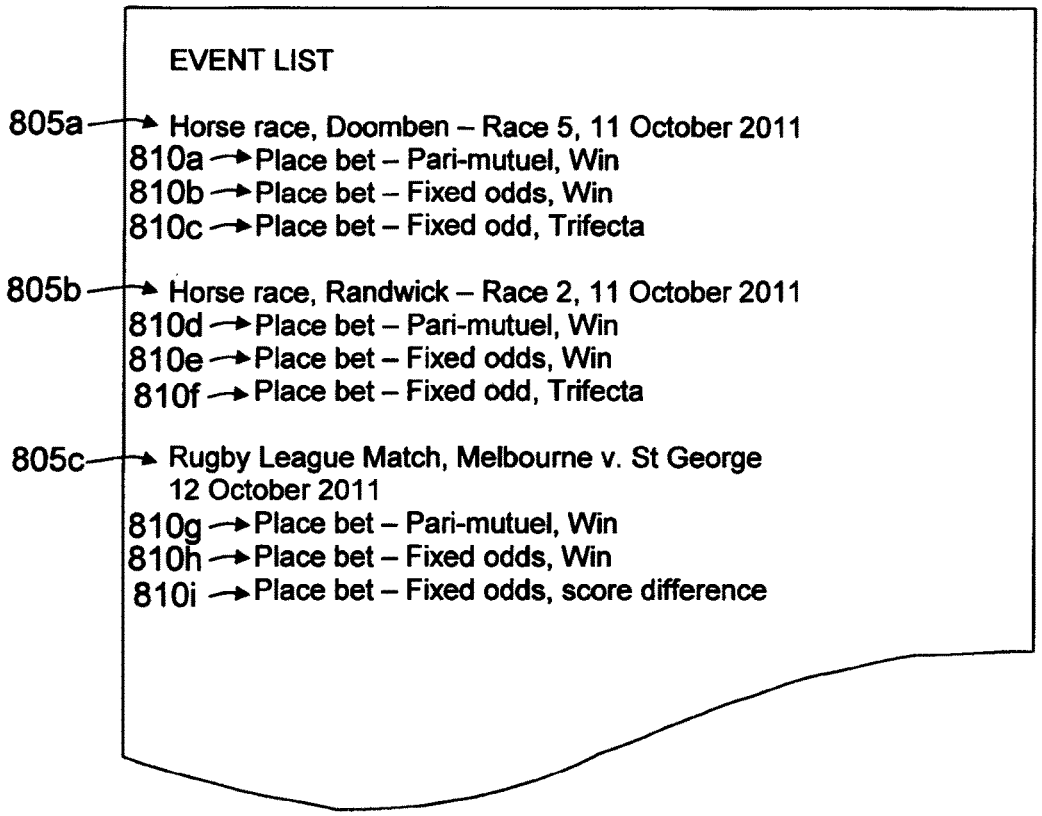
FIG. 8 is an illustration of an event list, according to an embodiment of the present invention.

FIG. 8 is an illustration of an event list 800, according to an embodiment of the present invention.

The event list 800 includes a plurality of events identifiers 805*a-c*, and each event identifier is associated with a plurality of betting product links 810*a-i*.

The plurality of event identifiers 805*a-c* is advantageously sorted according to user preferences, location or jurisdiction.

The plurality of betting product links 810*a-i* include links to both pari-mutuel and fixed odds products. The plurality of betting product links 810*a-l* provide links specific to their associated event. For example, betting product link 810*c*, linking to a fixed odd trifecta product, would not be suitable for the event associated with event identifier 805*c*.

Figure 9:
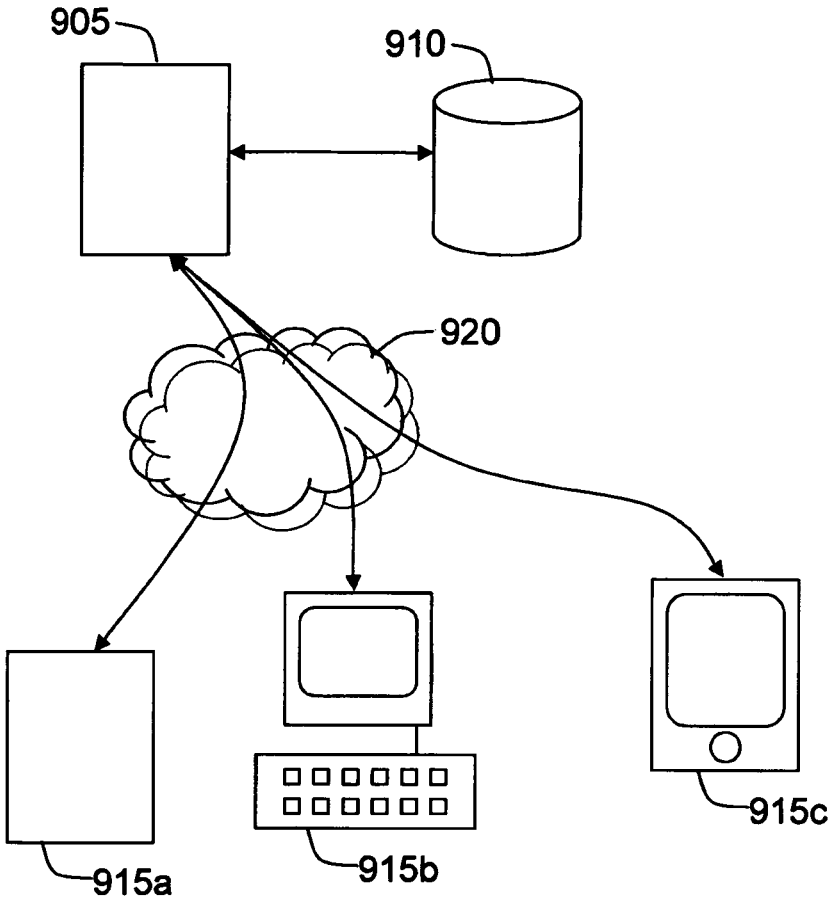
FIG. 9 is a diagrammatic illustration of a wagering system, according to an embodiment of the present invention.

FIG. 9 is a diagrammatic illustration of a wagering system 900, according to an embodiment of the present invention.

The wagering system includes a wagering server 905 connected to a database 910. The database may, for example, be the database 700 of FIG. 7, or any other suitable database.

The wagering server is connected to a plurality of devices 915*a-c* via a communications network 920.

The plurality of devices 915*a-c* include a purpose built kiosk device 915*a*, a personal computer 915*b* and a mobile device 915*c*.

The purpose built kiosk device 915*a* may be running an application on a computer processor, for example. The application may receive raw data via the communications network 920 which is displayed on a screen of the purpose built kiosk device 915*a*.

The personal computer 915*b* may provide access to the wagering system via a web browser, as will be readily understood by a person skilled in the art.

The mobile device 915*c* may include a purpose built application, such as an application for an iPhone device, manufactured by Apple Computer Inc. California, USA, as is known in the area of technology.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this patent specification is intended to embrace all alternatives, modifications and variations of the present invention that have been discussed herein, and other embodiments that fall within the spirit and scope of the above described invention.

We claim:

1. A computer-implemented method of wagering, the method comprising:

managing, by a computer system, an electronic data store having stored therein a data structure comprising a plurality of events, a data structure comprising a plurality of products and a data structure comprising a plurality of customer accounts, all of which are independently defined, wherein each event of the plurality of events is associated with an event type and each customer account is associated with a jurisdiction and an account tier;

receiving, via a communications network from a customer associated with a customer account of the plurality of customer accounts, a request for one or more events;

selecting by a computer processor and retrieving from the data store, event information about the one or more events, wherein access to the one or more events is governed by account-event rule configurations that are based on event types associated with the one or more events, a jurisdiction associated with the customer's account and a tier associated with the customer's account;

retrieving, from the data store, a plurality of the products wherein the plurality of products includes fixed odds and pari-mutuel products;

associating each of the one or more events with one or more products of the plurality of the products through an event-product rule configuration, wherein an event-product rule configuration specifies which product types of the plurality of products are compatible with which event types of the plurality of events;

identifying a channel type used by the customer; the channel type including one of a purpose built kiosk, a mobile phone, a computer application, and a browser based application, the channel type being associated with a device type that has associated device specifications;

filtering the one or more events according to a channel-event rule configuration based upon the channel type used by the customer, channel-event rule configuration including rules relating to which channels from the plurality of channels an event is available over;

filtering the one or more products according to a product-channel rule configuration based upon the channel type used by the customer, the product-channel rule configuration including rules relating to which channels from the plurality of channels a product is available over;

transmitting to the customer account, via a communications network, an event list including information relating to the filtered one or more events and the filtered one or more products associated with each of the filtered one or more events;

receiving, via a communications network, a wager from a customer in respect of an event of the plurality of events, a product of the plurality of products and a customer account of the plurality of customer accounts; and storing the wager, in the electronic data store, and associating the wager with the respective event, the respective product and the respective customer account.

2. The computer-implemented method of wagering of claim 1, further including:

receiving, via a communications network, information relating to an outcome of the event;

determining, on a computer processor, an outcome of the wager; and transmitting, via a communications network, the outcome of the wager.

3. The computer-implemented method of wagering of claim 1, wherein the one or more events are selected according to at least one of customer or account preference, location or jurisdiction.

4. The computer-implemented method of wagering of claim 1, wherein the event list is sorted according to at least one of customer or account preference, location or jurisdiction.

5. The computer-implemented method of wagering of claim 1, wherein links to the filtered one or more products associated with each of the filtered one or more events are included in the event list.

6. The computer-implemented method of wagering of claim 1, wherein the plurality of products include fixed odds and pari-mutuel products.

7. A computer system including:

a database for maintaining data associated with a plurality of events, a plurality of products, and at least one customer account, wherein the a plurality of events and the at least one customer account are stored in independent data structures that are independent of a data structure storing the plurality of products, and wherein each event of the plurality of events is associated with an event type and each customer account is associated with a jurisdiction and an account tier; and a computer coupled to the database, wherein the computer includes a processor and a memory, the processor and memory configured to:

receive, via a communications network from a customer associated with a customer account of the at least one customer account, a request for event information;

select and retrieve from the database, at least one event from the plurality of events wherein access to the at least one event is governed by an account-event rule configuration that is based on the event types associated with the at least one event, a jurisdiction associated with the customer's account and a tier associated with the customer's account;

retrieve, from the database, at least one product of the plurality of products;

associate each of the selected at least one event with at least one product of the plurality of the products through an event product rule configuration, wherein an event-product rule configuration specifies which product types of the plurality of products are compatible with which event types of the at least one event;

identify a channel type used by the customer; the channel type including one of a purpose built kiosk, a mobile phone, a computer application, and a browser based application the channel type being associated with a device type that has associated device specifications;

filter the at least one event according to a channel-event rule configuration based upon the channel type used by the customer, channel-event rule configuration including rules relating to which channels from the plurality of channels an event is available over;

filter the at least one product according to a product-channel rule configuration based upon the channel type used by the customer, the product-channel rule configuration including rules relating to which channels from the plurality of channels a product is available over;

transmit to the customer, via a communications network, an event list including information relating to the filtered at least one event and the filtered at least one product associated with each of the selected at least one event;

generate, based upon input from a customer associated with a customer account of the at least one customer account, records pertaining to a betting instance including the selected at least one event, a product from the plurality of products, and the customer account;

wherein the plurality of products includes pari-mutuel and fixed odds products.

8. A computer implemented wagering system, the wagering system including:

a computer coupled to a database, wherein the computer includes a processor and a memory, the database comprising:

an event module for storing a plurality of events wherein each event is associated with an event type;

a product catalogue module for storing a plurality of products, the plurality of products including at least pari-mutuel and fixed odds products;

a customer data module for storing a plurality of customer accounts with customer account data for a plurality of customers, wherein each customer account is associated with a jurisdiction and an account tier;

a betting instance module, for generating betting instances, the betting instances including an association to an event from the event module, to a product from the product catalogue module, and to a customer account from the customer data module; and an event-product rule module, which includes rules relating to which products from the plurality of products may be associated with an event;

a customer-channel rule module, which includes rules relating to which channels from the plurality of channels for which a customer will have access;

a product-channel rule module, which includes rules relating to which channels from the plurality of channels a product is available over; and an event channel rule module, which includes rules relating to which channels from the plurality of channels an event is available over;

the processor and memory configured to:

receive, via a communications network from a customer associated with a customer account, a request for event information;

select and retrieve from the event module, at least one event, wherein access to the at least one event is governed by account-event rules that are based on event types associated with the at least one event, a jurisdiction associated with the customer's account and a tier associated with the customer's account;

retrieve, from the product catalogue module, at least one product of the plurality of products;

associate each of the selected at least one event with at least one product of the plurality of the products based on the rules of the event-product rule module;

identify a channel type used by the customer; the channel type including one of a purpose built kiosk, a mobile phone, a computer application, and a browser based application;

filter the at least one event according to a channel-event rule configuration based upon the channel type used by the customer, channel-event rule configuration including rules relating to which channels from the plurality of channels an event is available over;

filter the at least one product according to a product-channel rule configuration based upon the channel type used by the customer, the product-channel rule configuration including rules relating to which channels from the plurality of channels a product is available over;

transmit to the customer, via a communications network, an event list including information relating to the filtered at least one event and the filtered at least one product associated with each of the selected at least one event.

9. The computer implemented wagering system of claim 8, wherein the event module includes, for each of the plurality of events at least one contestant, and the betting instance module includes an association to a contestant from the event module.

10. The computer implemented wagering system of claim 8, wherein the customer data module includes, a plurality of accounts for a customer, and the betting instance module includes an association between the customer and the plurality of accounts.

11. The computer implemented wagering system of claim 8, further including an account-event rule module, which includes rules relating to which events from the plurality of events may be associated with an account.

12. The computer implemented wagering system of claim 8, further including a channel module, for storing information relating to a plurality of channels.

* * * * *